US006598445B2

(12) United States Patent
Mohring et al.

(10) Patent No.: US 6,598,445 B2
(45) Date of Patent: Jul. 29, 2003

(54) LEVELING MACHINE AND METHOD

(75) Inventors: David L. Mohring, Napoleon, OH (US); Kurt R. McMutrie, Defiance, OH (US); Rick L. Behnfeldt, Napoleon, OH (US)

(73) Assignee: Automatic Feed Company, Napoleon, OH (US)

( * ) Notice: Subject to any disclaimer, the term of this patent is extended or adjusted under 35 U.S.C. 154(b) by 0 days.

(21) Appl. No.: 09/835,538

(22) Filed: Apr. 16, 2001

(65) Prior Publication Data

US 2002/0148268 A1 Oct. 17, 2002

(51) Int. Cl.[7] ..... B21D 1/02
(52) U.S. Cl. ..... 72/163; 72/247
(58) Field of Search ..... 72/163, 165, 160, 72/247

(56) References Cited

U.S. PATENT DOCUMENTS

| | | | | | |
|---|---|---|---|---|---|
| 2,945,530 | A | * | 7/1960 | Maust | 72/163 |
| 3,327,509 | A | * | 6/1967 | Roesch | 72/163 |
| 4,454,738 | A | | 6/1984 | Buta | 72/163 |
| 4,635,458 | A | | 1/1987 | Bradlee | 72/165 |
| 4,698,990 | A | | 10/1987 | Petri et al. | 72/165 |
| 4,730,472 | A | | 3/1988 | Ellis | 72/164 |
| 4,887,343 | A | | 12/1989 | Ohishi | 72/16 |
| 5,097,691 | A | | 3/1992 | Slabowski et al. | 72/165 |
| 5,127,250 | A | | 7/1992 | Nagata | 72/165 |
| 5,392,627 | A | | 2/1995 | Benz | 72/163 |
| 5,412,968 | A | | 5/1995 | Benz | 72/164 |
| 5,461,895 | A | | 10/1995 | Lemper et al. | 72/165 |
| 5,479,806 | A | | 1/1996 | Benz | 72/165 |
| 5,622,072 | A | | 4/1997 | Benz | 72/163 |

FOREIGN PATENT DOCUMENTS

| | | | | |
|---|---|---|---|---|
| DE | 642790 | * | 3/1937 | 72/163 |
| IT | 318522 | * | 3/1935 | 72/163 |
| JP | 60-33822 | * | 2/1985 | 72/163 |
| JP | 60-33823 | * | 2/1985 | 72/163 |
| JP | 60-33824 | * | 2/1985 | 72/163 |
| JP | 60-33825 | * | 2/1985 | 72/163 |

* cited by examiner

*Primary Examiner*—Daniel C. Crane
(74) *Attorney, Agent, or Firm*—Fay, Sharpe, Fagan, Minnich & McKee, LLP

(57) ABSTRACT

An assembly and method for leveling a metal strip by working the strip back-and-forth through a plurality of work rolls. Work rolls are disposed for engaging the strip. A backup roll supports the work roll against the strip. A cam roll supports the backup roll and is mounted to a frame with a bracket. A position guide assembly is associated with the backup roll for selectively adjusting a relative position of the backup roll to the cam roll. The position guide preferably comprises a screw and guide pin assembly mounted to the frame and a yoke attached to end portions of a plurality of the backup rolls. The adjusting comprises moving the backup roll relative to the cam roll to avoid undesired wear on only limited portions of the backup rolls.

5 Claims, 6 Drawing Sheets

LEVELING MACHINE AND METHOD

FIELD OF THE INVENTION

The subject invention relates to leveling machines of the type that are usually used for leveling sheet or strip steel or aluminum wherein the sheets or strips are wound into a coil that needs to be flattened before being used in further manufacturing processes. Such leveling machines typically include pluralities of upper and lower leveler rolls, relatively offset, to effectively flex the strip back and forth until the coil tendencies are worked out and the strip is flat. The leveling rollers actually engaging the workpiece are supported over their length by full length backup rolls which in turn are supported by cam follower backup rolls, all effectively supported by a frame housing.

BACKGROUND OF THE INVENTION

Leveling machines for working the coiling tendencies out of wound strip or sheet are well known. Such leveling assemblies typically comprise a frame supporting a cassette portion having the work rolls and disposed within the frame. The machine is configured to receive the workpiece at a work area defined by opposed and offset work rolls. The line of work rolls are positioned to effectively work the strip back and forth until the coiling tendencies are removed from the workpiece, and the piece is flat and more useful for further manufacturing processes.

It is common to support the work rolls with adjacent and engaging full length backup rolls which buttress the work rolls into the desired positions relative to the workpiece. The backup rolls are essentially coextensive with the work rolls to provide corresponding full length backup. The full length backup rolls are in turn supported by a plurality of cam follower backup rolls which are usually somehow mounted to the frame by braces, but are configured to engage only a portion of the full length backup rolls. In other words, the cam follower backup rolls are not dimensioned to extend across and engage the full length of the backup rolls. The relative dimensioning of the cam follower backup rolls to engage only a portion of the full length backup rolls better accommodates the cassette portion construction and its reception in the frame housing.

The particular problems which are overcome by the subject invention result from the wear engagement between the cam follower backup rolls and the full length backup rolls. More particularly, since the cam follower backup rolls contact only a portion of the full length backup rolls, the engaging portions remain static and therefore constant, and wear areas, typically comprising depressions in the backup rolls, can occur. Changes in the relative dimensioning of the cam follower backups and the full length backups between the frame and workpiece will necessarily affect the dimensioning and relative positioning of the work rolls relative to the frame and the workpiece, and thereby have undesirable effects on the efficiency of the overall leveling process, as well as on the useful life of the components in the leveling assembly. When such problems arise to the level that repair or reconstruction of the leveling assembly is needed, entire sets of full length backup rolls have to be removed and replaced, requiring extensive repair work, substantial disassembly of the overall apparatus, and the discarding of the unacceptably worn full length backup rolls, not to mention the problems of the down time of the leveling machine itself. A related inefficiency is that the wear areas on the full length backup rolls are limited to only certain portions comprising the engagement areas. Other areas of the full length backups are not worn at all.

There is a substantial need to provide a leveling assembly which either avoids or compensates for such wear problems, and which can do so in a manner that is reliable, consistent and convenient to an operator.

The subject invention contemplates a new and improved leveling assembly which overcomes the above problems and others to provide a new leveler which avoids assembly failure due to wear on the full length backup rolls, is readily adaptable to a plurality of leveling assemblies having a variety of dimensioning characteristics, reduces the need for repair and reconstruction of the assembly, and which provides improved longevity and accuracy in operation of leveling apparatus.

BRIEF SUMMARY OF THE INVENTION

In accordance with the present invention, there is provided an assembly for leveling a metal workpiece during movement of the piece therethrough, including a work roll for engaging and working the strip. A backup roll supports the work roll against the strip. A cam roll supports the backup roll against the work roll. A frame supports the cam roll against the backup roll. A positioning guide is associated with the backup roll for selectively adjusting a relative position of the backup roll to the cam followers for compensating for wear on the backup roll caused by the cam followers. The adjusting of the relative position comprises moving the area of engagement between the cam roll and the backup roll.

In accordance with another aspect of the invention, the position guide is supported by the frame and is disposed for adjusting the relative position of the backup rolls in a direction transverse to the strip movement. The position guide includes an adjustment member connected to an end portion of the backup roll at a first adjuster end, and the frame at the second adjuster end, whereby operator control of the position guide adjuster correspondingly adjusts the spacing between the backup roll end portion and the frame. The result of such adjusting is a relative change in engagement position between the cam roll and the backup roll, thereby avoiding the prospects of undesired wear at a single position of engagement. A yoke assembly conveniently serves to facilitate the position adjustment of the plurality of backup rolls consistently and accurately.

In accordance with a more particular aspect of the invention, the backup roll is dimensioned to extend about a width of a strip workpiece. The cam roll comprises a plurality of cam rolls, each dimensioned to engage a portion of the backup roll and disposed to provide spacings between the areas of contact with the backup roll. The adjusting of the relative positions by the position guide assembly comprises adjusting the engaging portions for movement into at least a portion of the spacings.

In accordance with the present invention, a method is provided for flattening strip by adjusting a leveling apparatus to avoid or compensate for back up roll marks on component elements due to operating wear. The apparatus includes work rolls braced by a frame and intermediate rolls, wherein the frame engages the intermediate rolls at spaced positions. The method comprises steps of supporting the intermediate rolls to the frame with an adjustable guide system for adjusting a position of the intermediate rolls relative to the frame. In anticipation of undesired component wear, the guide systems are adjusted to shift the spaced positions of engagement between the frame and the intermediate rolls to different positions of engagement.

One benefit obtained by use of the present invention, is a leveling apparatus having a cassette portion comprising work rolls for flattening strip or sheet which minimizes wear problems on backup rolls supporting the work rolls.

A further benefit of the present invention is a yoke system for commonly supporting the backup rolls for facilitating accurate position adjustment of a plurality of backup rolls relative to the cam followers. The yoke is conveniently adjusted with an adjustment screw and guide pin assembly.

A further benefit of the present invention is the minimization of repair and reconstruction of the leveling apparatus due to dimensioning changes attributable to backup roll wear.

Other benefits and advantages for the subject invention will become apparent to those skilled in the art upon a reading and understanding of the specification.

BRIEF DESCRIPTION OF THE DRAWINGS

The invention may take physical form in certain parts and steps and arrangements of parts and steps, the preferred embodiments of which will be described in detail in the specification and illustrated in the accompanying drawings which form a part hereof and wherein.

DETAILED DESCRIPTION OF THE PREFERRED EMBODIMENT

Figure 1:
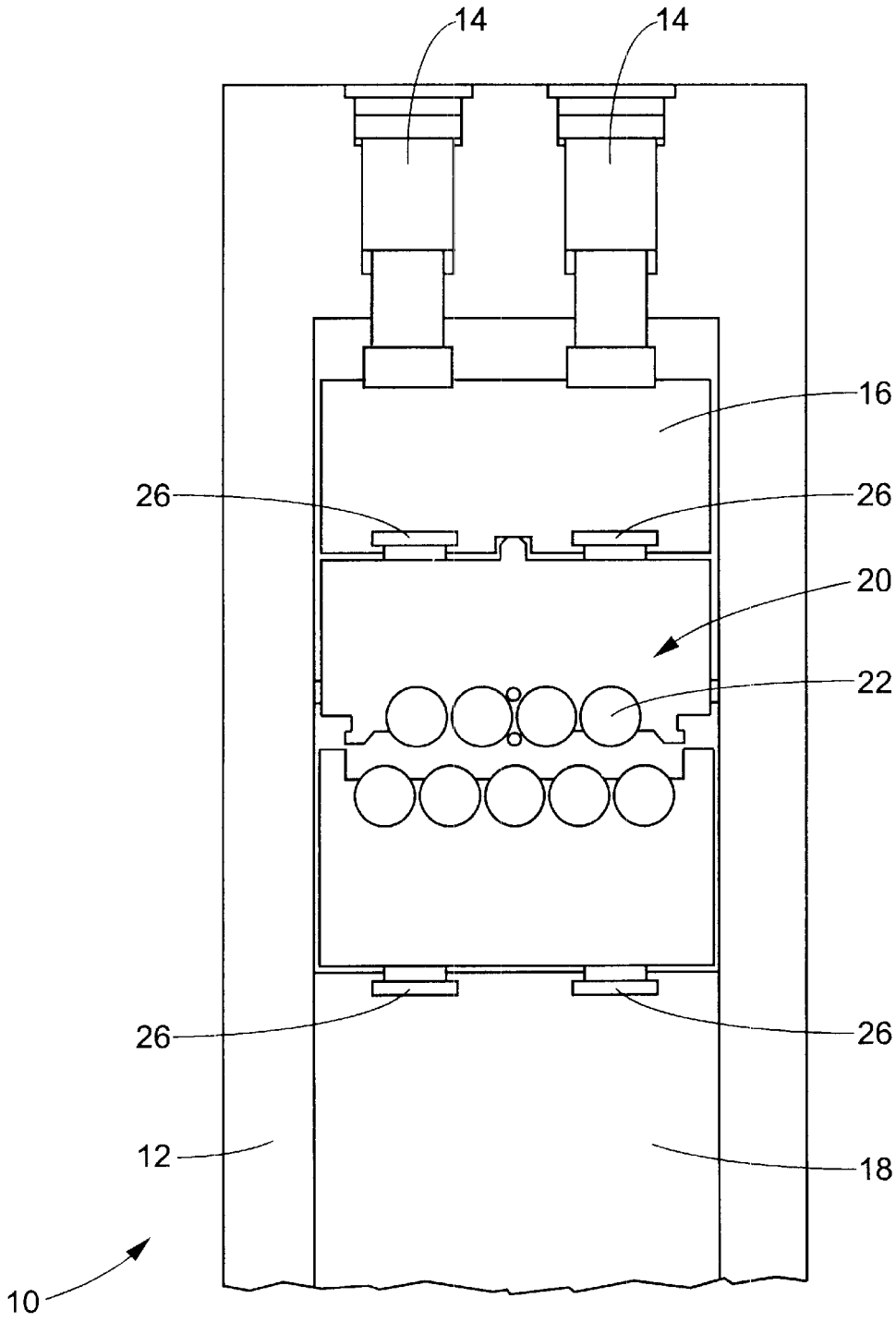
FIG. 1 is a general sectional view of a leveling machine.

Referring now to the drawings wherein the showings are for purposes of illustrating the preferred embodiments of the invention only and not for purposes of limiting the invention.

FIG. 1 shows a leveling machine 10 particularly useable for working a workpiece (not shown) such as a coil of steel or aluminum to flatten the workpiece out of the coiling tendencies placed in the strip as a result of the coiling. An overall frame or housing 12 includes adjusting screw jacks 14 for the positioning of an upper bridge 16 adjacent a cassette assembly 20. The cassette assembly 20 includes the work rolls 22 which actually engage and deflect the workpiece in a back-and-forth motion to accomplish the desired flattening of the workpiece. A lower bridge 18 also supports the cassette 20. Position compensating wedges 26 more precisely define the relative positions of the cassette 20 and work rolls 22 relative to the bridges 16, 18.

Figure 2:
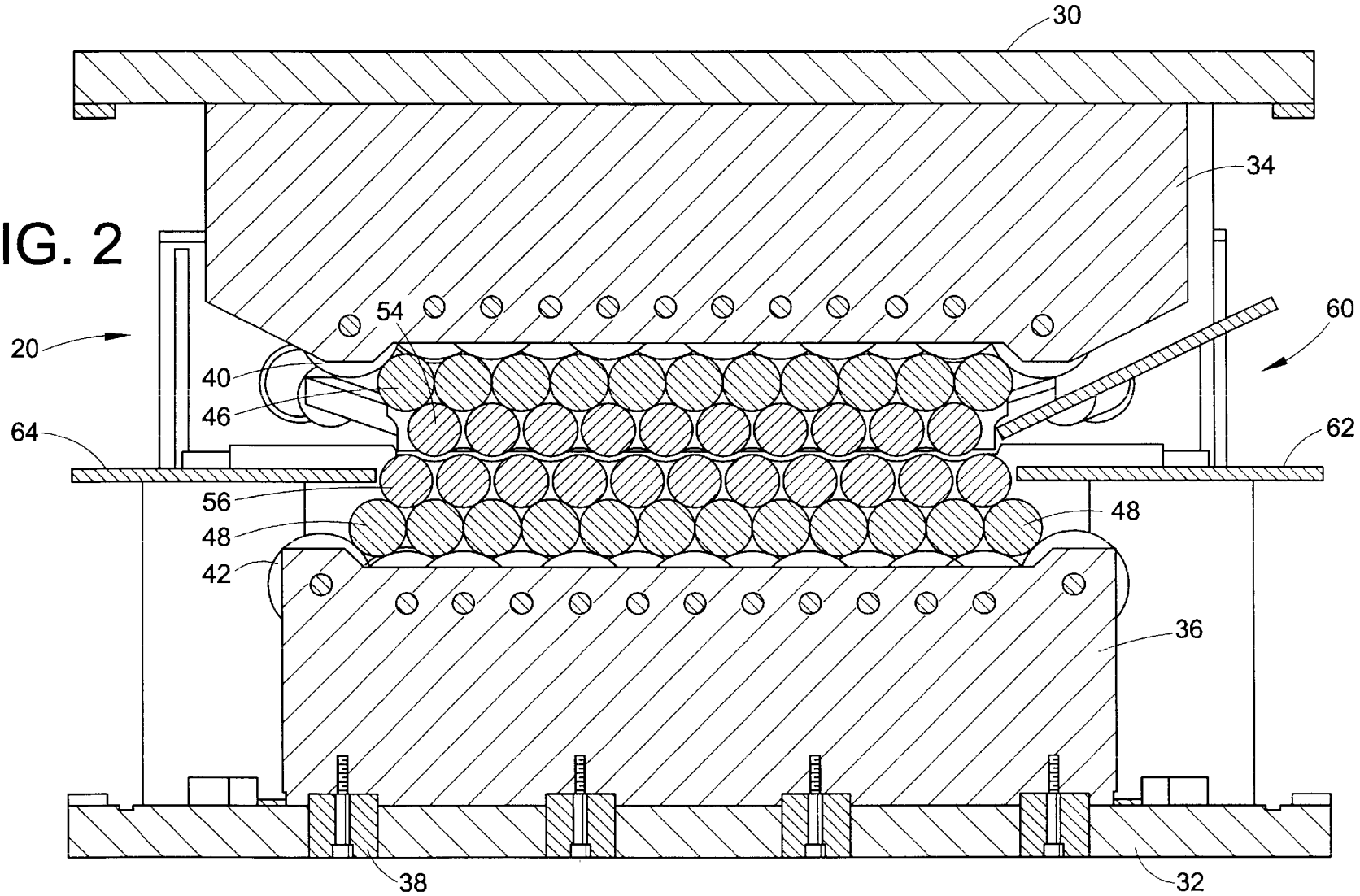
FIG. 2 is a more detailed sectional view of a cassette portion of the leveling machine in FIG. 1, more particularly illustrating positional relationships of work rolls.

The cassette 20 more particularly shown in FIG. 2 includes top and bottom framing plates 30, 32 which are clamped by the upper bridge, lower frame and wedges 26 (FIG. 1). The plates 30, 32 are fastened to side housings and backup brackets 34, 36 with conventional fastening devices 38. The brackets support a plurality of cam follower backup rolls 40, 42, which engage a plurality of full length backup rolls 46, 48, which in turn support the plurality of upper work rolls 54 and lower work rolls 56. The backup rolls are thus intermediate the cam rolls 40, 42 and work rolls 54, 56. The plurality of work rolls 54, 56 engage a workpiece received in cassette entrance area 60 at entrance baffle plate 62. After flattening through the leveling apparatus 10, the workpiece exits the cassette at exit baffle plate 64.

Figure 3:
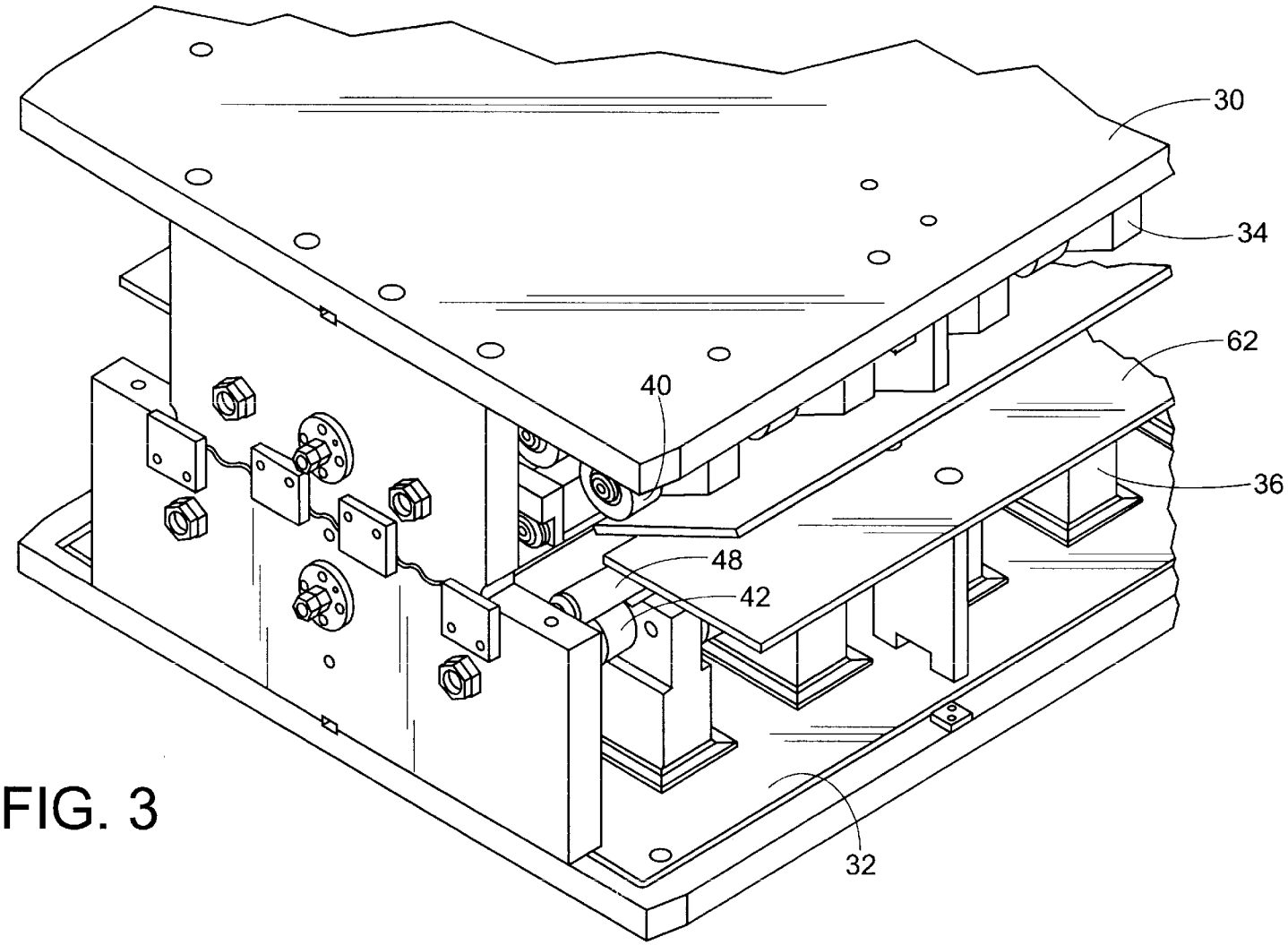
FIG. 3 is an elevated perspective view more particularly illustrating the screw and guide pin assembly supporting the backup rolls.
Figure 4:
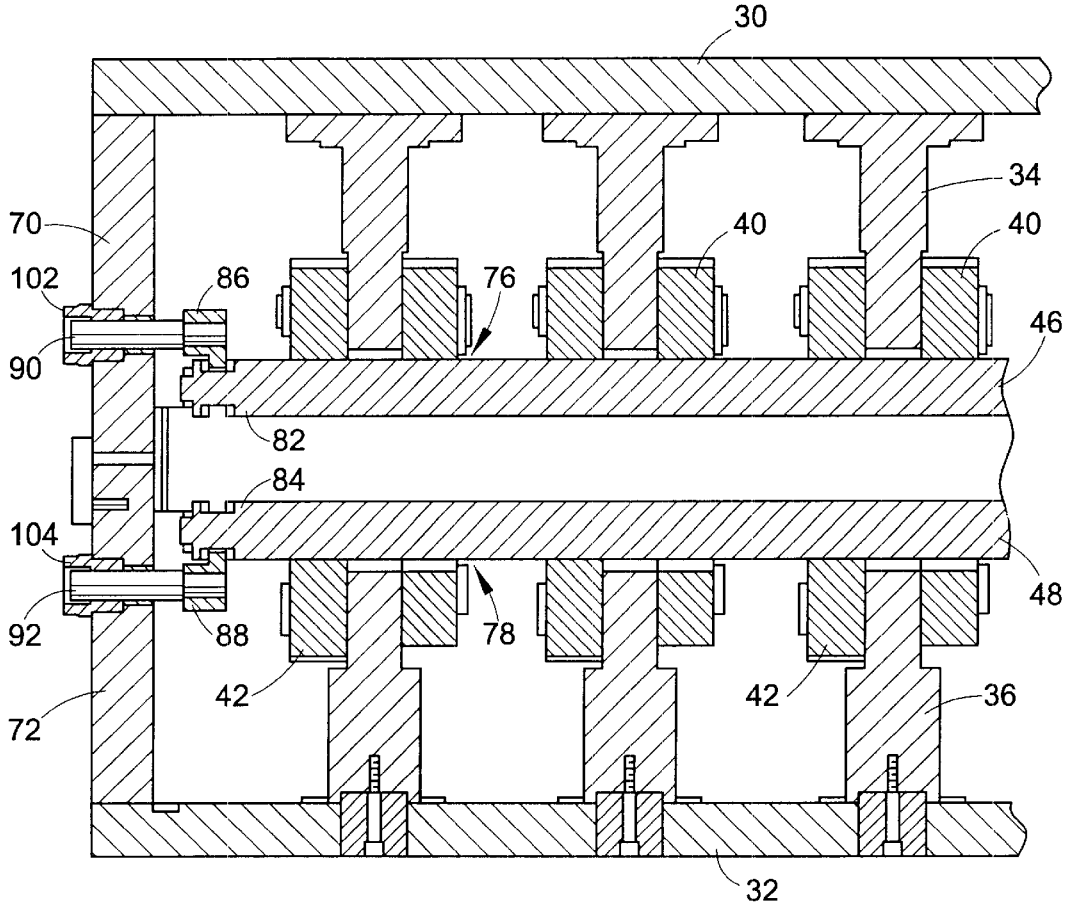
FIG. 4 is a schematic sectional view particularly showing the guide pin and yoke assembly relative to the backup rolls.
Figure 5:
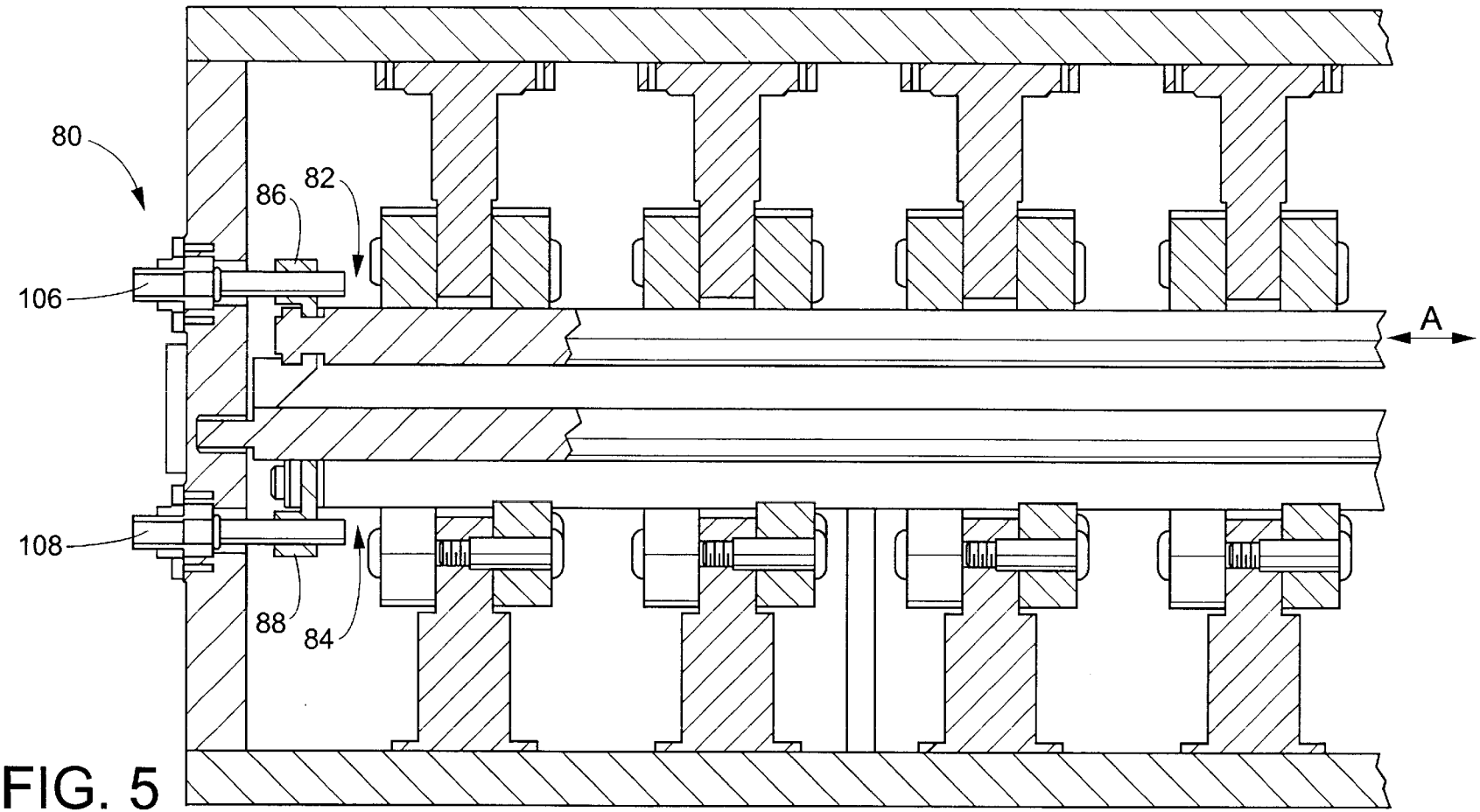
FIG. 5 is another sectional view similar to FIG. 4, except that the position adjustment screw assembly relative to the yoke is more clearly shown.
Figure 6:
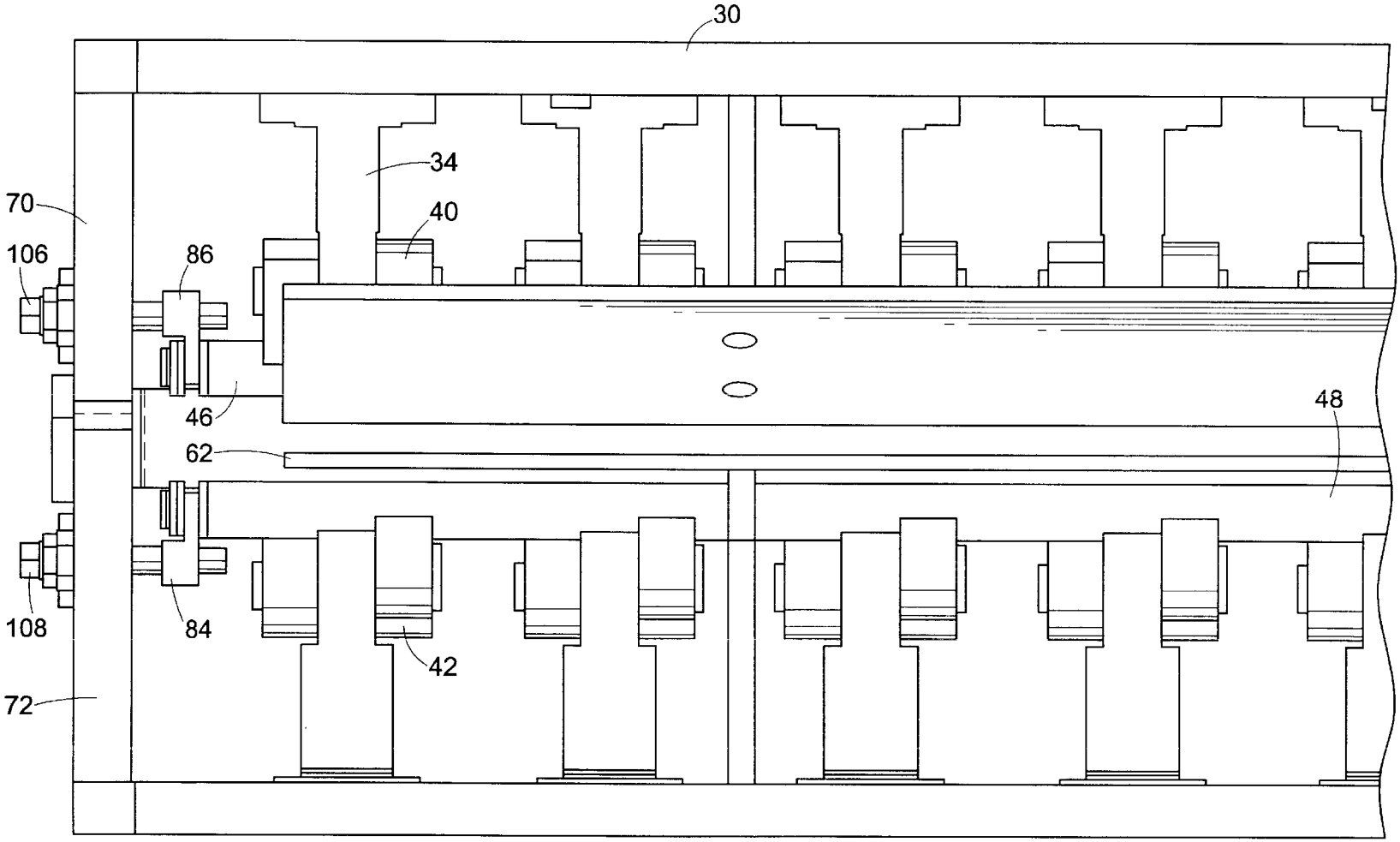
FIG. 6 is a more general side elevational view of the cassette portion particularly illustrating the relationship of the cam follower backup rolls to the full length backup rolls.

With reference to FIGS. 3 and 4, the arrangement of the plates 30, 32, frame supports 34, 36 and full length backup rolls 46, 48 can be seen from a different perspective better illustrating the engagement relationship between the cam follower backup rolls 40, 42 and the full length backup rolls 46, 48.

It is a feature of the invention that the full length backup rolls 46, 48 are not merely supported by the cam follower backup rolls 40, 42, but also by an adjustable guide pin and yoke assembly secured relative to an upper control side housing 70 and lower control side housing 72, respectively. The disposition and operation of the guide pin and yoke assembly relative to the full length backup rolls 46, 48, is a particular feature of the invention.

As can be seen in FIG. 4, the cam follower backup rolls engage only a limited portion of the full length backup rolls, i.e., limited areas of contact 76, 78 which can provide wear areas over time and operation of the apparatus 10. Those areas of the full length backup rolls 46, 48 not engaging the cam follower backup rolls 40, 42 are not subject to such wear. The avoidance of only the limited wear areas in the full length backup rolls 46, 48 is an objective of the invention.

With particular reference to FIGS. 3–6, a position guide system for the transverse positional adjustment of the full length backup rolls relative to side housing members 70, 72, and thus also are relative to cam follower backup rolls 40, 42, is illustrated. The relative position of the backup rolls 46, 48 to cam rolls 40, 42 is affected by a guide pin and yoke assembly 80 which supports and engages terminal end portions 82, 84 of the full length backup rolls 46, 48. The precise structural assembly for fastening the end portions 82, 84 to the yoke 86 is not of so much importance as the aspect of affecting an adjustment of a transverse position of the full length backup rolls 46, 48 relative to the cam follower backup rolls 40, 42 in either direction, as illustrated by directional arrow A. Thus, an operator of the apparatus 10 can selectively adjust the relative position of the backup rolls relative to the cam rolls for compensating for any wear on the backup rolls caused by the cam roll engagement over time. By "transverse" as a direction of movement, is meant a direction orthogonal to the movement of the strip workpiece through the assembly 10. Such transverse directional movement avoids singular areas of wear in engagement because the cam follower backup rolls are not fixed in a relative position to the full length backup rolls.

An upper yoke member 86 engages the end portions of all the upper full length backup rolls 46, while a lower yoke member 88 engages the end portions of the plurality of lower full length backup rolls 48. A smooth and precise positioning adjustment in the transverse direction is facilitated by guide pins 90, 92 which are attached to the adjustment end portions 82, 84 by the yokes 86, 88. The guide pins are closely received in the side housings 70, 72 with conventional bushing assemblies 102, 104. The other ends of the rolls [not shown] are not so attached to the frame, but rather are adequately supported by the cam follower backup rolls, and held in place by the yoke.

Actual positional adjustment is effected by an operator with adjustment screws 106, 108 (FIGS. 3 and 5) fastened to the upper and lower side control housings with a conventional nut, washer and bearing fastening assembly. Thus, an operator wishing to adjust the relative position of the upper full length backup roll 46 relative to the upper cam follower backup rolls 40, adjusts adjustment screw 106 which, in turn, causes upper yoke 86 to move so that all of the plurality of upper full length backup rolls 46 connected to the yoke 86 will move in accordance with the adjustment of the screw. The guide pins 90 also mounted to the upper yoke 86 facilitate the consistent and precise movement of the entire plurality of the upper full length backup rolls relative to the upper control side housing 70. For similar adjustment of the plurality of lower full length backup rolls 48, adjustment screw 108 is selectively turned by the operator. As can be seen with reference to FIGS. 3 and 6, the precise relative positioning of the rolls in such transverse directions by the adjustment screws is visually detectable by an operator.

The invention has been described with reference to preferred embodiments, obviously alterations and modifications will occur to those of ordinary skill in the art. It is our intention to include all such equivalents within the scope of the invention.

We now claim:

1. An assembly for leveling a metal strip during strip movement therethrough comprising:

a work roll for engaging and working the strip;

a backup roll supporting the work roll against the strip;

a cam roll supporting the backup roll against the work roll;

a frame supporting the cam roll against the backup roll;

a position guide supported by the frame and disposed for adjusting a relative position of the backup roll to the cam roll in a direction transverse to the strip movement, the position guide including an adjustment member connected to an end portion of the backup roll at a first adjuster end, and the frame at a second adjuster end whereby operator control of the position guide correspondingly adjusts a spacing between the backup roll end portion and the frame; and, first and second support members, the first support member supporting the cam roll and the second support member supporting the position guide, the support members having fixed positions relative to the spacing adjustment of the position guide.

2. An assembly for leveling a metal strip during strip movement therethrough comprising:

a work roll for engaging and working the strip;

a backup roll supporting the work roll against the strip;

a cam roll supporting the backup roll against the work roll;

a frame supporting the cam roll against the backup roll; and, an adjustment screw associated with the backup roll for selectively adjusting a relative position of the backup roll to the cam roll.

3. The assembly as defined in claim 1 further including a guide pin attached to the adjustment screw.

4. A method of flattening a strip by adjusting a leveler to avoid or compensate for position cam roll marks on intermediate rolls due to operating wear, the leveler including work rolls braced by a frame and a plurality of the intermediate rolls wherein the frame engages the intermediate rolls at spaced positions by cam rolls the method comprising the steps of:

fixing the intermediate rolls to the frame with a guide system for adjusting a position of the intermediate rolls relative to the cam rolls by adjusting a screw position of a yoke assembly fastened to the intermediate rolls;

in anticipation of undesired backup roll marks, adjusting the guide system to shift the spaced positions of engagement between the cam rolls and the intermediate rolls to a shifted position of engagement; and, moving the strip through the leveler.

5. The method as defined in claim 4 wherein the screw position adjusting collectively positions the plurality of intermediate rolls.

* * * * *